United States Patent [19]

Müller

[11] Patent Number: 4,830,064

[45] Date of Patent: May 16, 1989

[54] MECHANICAL LOOM

[75] Inventor: Jakob Müller, Stansstad, Switzerland

[73] Assignee: Textilma AG, Hergiswil, Switzerland

[21] Appl. No.: 89,326

[22] Filed: Aug. 25, 1987

[30] Foreign Application Priority Data

Sep. 10, 1986 [CH] Switzerland ..... 3644/86

[51] Int. Cl.[4] ..... D03D 47/24

[52] U.S. Cl. ..... 139/437; 139/443; 139/445

[58] Field of Search ..... 139/11, 429, 437, 439, 139/440, 443, 446, 445

[56] References Cited

U.S. PATENT DOCUMENTS 3,388,722 6/1968 Sakamoto ..... 139/437

4,030,526 6/1977 Kiener ..... 139/445

FOREIGN PATENT DOCUMENTS 981918 1/1951 France ..... 139/443

*Primary Examiner*—Henry S. Jaudon

*Attorney, Agent, or Firm*—Toren, McGeady & Associates

[57] ABSTRACT

A mechanical loom including a shooting device for shooting a shuttle into the shed from an initial position into a receiving position at a transfer device. The shuttle is connected through a flexible return element to a return member of a return device, so that the shuttle can be returned into the initial position and, simultaneously, a weft thread can be pulled into the shed. The return device includes a release device which releases the return element from the return member when the shuttle has reached the initial position. The mechanical loom is of simple construction and low weight. The weft thread is pulled into the shed in a careful manner, so that the weaving machine has a high efficiency.

31 Claims, 4 Drawing Sheets

MECHANICAL LOOM

BACKGROUND OF THE INVENTION

1. Field of the Invention

The present invention relates to a mechanical loom including a shuttle for a weft thread, wherein the shuttle is shootable into the shed by means of a shooting device. The loom further includes a return device for the shuttle and a transfer device for transferring a weft thread to the shuttle.

2. Description of the Prior Art

Mechanical looms of the above-described type are known, for example, from Hollstein, Fertigungstechnik Weberei [Manufacturing Technology Weaving], Vol. 2, Mechanismen [Mechanisms], VEB Fachbuchverlag Leipzig, 1980, pages 143 to 190. Mechanical looms can be equipped either with bobbin shuttles or gripper shuttles.

In mechanical looms having bobbin shuttles, these shuttles include a bobbin with a supply of weft thread and, after each change of the shed of the warp thread, are alternatingly shot through the open shed from one or the other side of the fabric. The shooting devices are picking devices arranged on both sides of the shed. Since the bobbin shuttles must have a substantial supply of bobbins, these shuttles are relatively large and of great weight, so that the weaving speed, and thus, the output of the loom can only be relatively small. In addition, the bobbin shuttles can only receive a limited supply of thread, so that they must be exchanged within a short period of time against shuttles with full bobbins. Consequently, it is difficult to obtain patterns, i.e., to introduce weft threads of a different type or different color. Looms with bobbin shuttles are relatively expensive and cumbersome.

Some of the above-described disadvantages are avoided in gripper shuttles in which the shuttles do not have bobbins but gripping devices for a portion of the weft thread to be pulled through the shed. In mechanical looms with gripper shuttles, these shuttles are shot through the shed by means of a shooting device from only one side of the shed and pull a corresponding portion of the weft thread into the shed. A return device is required for returning the gripper shuttle or shuttles from the other side of the shed back to the shooting side. This requires complicated transport devices which return the gripper shuttle underneath the fabric web to the shooting side. During the travel through the shed, the gripper shuttles are usually guided on the weaving reed by means of guide devices, such as, guide lamella.

In mechanical looms of this type, it is a disadvantage that a plurality of gripper shuttles are required which must be returned by means of a complicated return device from the other side of the fabric web to the shooting side. In addition, the gripper shuttles must have a relatively large mass, so that a shooting device constructed as a picking device is capable of imparting to the gripper shuttle a kinetic energy of such a magnitude that it is capable of pulling the weft thread through the shed. Compared to the above-described looms with bobbin shuttles, the gripper shuttles have an improved output, however, the output is still limited and the loom is of relatively complicated construction.

Further improvements in mechanical looms are obtained if grippers are used which are moved in a positively guided manner. In these mechanical looms the grippers are pushed or pulled through the shed by means of rods or flexible belts. In unilateral grippers, the weft thread is introduced from only one side by either pushing or pulling the weft thread during the forward and backward motion by means of mechanically driven tension elements or compression elements. In two-sided grippers, a weft thread is introduced from one side of the shed into the middle thereof and is then taken over by a gripper introduced from the other side and is pulled out of the shed by means of this other gripper. If the gripper is mounted on rods, the mechanical loom requires a large installation space due to the length of the rods. In addition, due to the large masses of the rods to be moved, the weaving speeds are limited. By mounting the grippers on flexible steel or plastic belts, the mass of gripper and belt can be reduced and the structural size at the side of the mechanical loom can also be reduced, however, the wind-up devices for the belt require drive elements which are of great volume and weight, so that such a mechanical loom is still cumbersome and complicated and the efficiency and flexibility are limited. Since the grippers are moved in a positively guided manner, the times for introducing and removing them are fixed within narrow limits, so that unfavorable weft introducing conditions exist.

It is, therefore, the primary object of the present invention to improve a mechanical loom of the above-described type in such a way that the loom is of simpler construction while facilitating improved efficiency.

SUMMARY OF THE INVENTION

In accordance with the present invention, the weft thread is introduced during the return movement of the shuttle. The shuttle is coupled by means of a flexible return element to a return member of the return device. The return device includes a release device which releases the return element from the return member when the initial position of the shuttle is reached.

Since the shuttle is pulling the weft thread into the shed during the return movement of the shuttle, wherein this return movement is carried out by means of a flexible return element, the shuttle can be shot through the shed without any load applied to it during the empty stroke. As a result, the shuttle may have a smaller weight than is the case in known gripper shuttles. In addition, the shuttle can be shot through the shed with a higher speed.

Since the return movement of the shuttle is carried out in a positively guided manner, the energy of the shuttle is no longer of consequence for the introduction of the weft thread into the shed during the return movement of the shuttle. Since the time required for shooting the shuttle into the shed is extremely short, a longer period of time or movement phase is available for pulling in the weft thread by means of the flexible return element. Accordingly, the pulling-in of the weft thread is more exact during an optimum movement phase of the mechanical loom. Also, the lower weight of the shuttle facilitates a simpler and lighter shooting device.

Since the flexible element is only required for the return procedure in which it is subjected to tensile load and, thus, contrary to the above-described known grippers, is not subjected to a compression load, it can be constructed of substantially lighter weight, so that a further reduction of the inertia forces results. Since, moreover, the return device does not have to apply compression forces on the flexible return element, and since the return device is not required for shooting in the shuttle, the return device can also be of extremely simple construction and low weight.

Consequently, the number and the weight of the components necessary for introducing the weft thread are essentially reduced, so that significantly higher outputs can be achieved with the mechanical loom according to the present invention than with the known mechanical looms.

In accordance with a feature of the present invention, the return element may be a rope, such as, a thread, a wire, a steel rope or particularly a reinforced plastic rope. The return element may also be a belt. As a result, the guidance of the belt and the movement path of the shuttle can be stabilized to some extent. The belt may also be a steel belt or advantageously a reinforced plastic belt.

In accordance with another feature of the invention, a supply of thread may be wound onto the shuttle at the transfer device for the weft thread, wherein the length of the thread supply corresponds to the length of the weft thread to be introduced. The thread can wind off during the return movement of the shuttle. Since the force for aftertightening a weft thread to be introduced is omitted, the force required for returning and introducing the weft thread is reduced.

However, in accordance with a simpler embodiment of the invention, the shuttle is constructed as a gripper shuttle for gripping a weft thread fed by the transfer device. Accordingly, the shuttle must grip the thread at the transfer station and pull it through the shed. It is advantageous if the transfer device for the thread includes an appropriate supply of thread, so that the tensile forces acting during the introduction of the weft thread are reduced.

In the mechanical loom according to the present invention, the shuttle may be shot into the shed in an unguided manner. However, a guide device for guiding the shuttle may be provided at the weaving reed. In the simplest case, the guide device may be a guide recess for the shuttle formed in reed rods of the weaving reed in the region of the stop for the weft thread, however, the resulting guidance is only a limited positive guidance. Therefore, a more advantageous feature of the present invention provides that the guide device includes projections which laterally extend over the shuttle. As a result, the movement path of the shuttle is more exactly defined. The guide device may be capable of holding the shuttle in a receiving position at the transfer device, so that additional support members at the transfer device are unnecessary.

It is basically possible to hold the shuttle in the initial position at a holder which is mounted stationary on the frame of the mechanical loom. The shuttle can then only be shot and received when the weaving reed has assumed the appropriate position. Therefore, a more advantageous embodiment of the invention provides that the weaving reed includes a lateral arm with a holder for holding the shuttle in the initial position and at the shooting device. As a result, the shuttle can be shot and returned even during the movement phase of the weaving reed.

A variety of possibilities exist for constructing the return device. For example, the return device may include a revolving return member to which the end of the return element is releasably connected. Also, the return device may include a revolving member on which an outwardly projecting return member is fastened. The end of the return element may have a drive member which in the receiving position of the shuttle is placed on the forwardly moving portion of the revolving member in the travel path of the return member, so that the drive member of the return member is grasped by the return member and is taken to the release device.

In accordance with a particularly advantageous embodiment of the invention, the return device has a return member which revolves along a closed, preferably circular, movement path, wherein the return element is guided in a forward movement portion of the movement path facing the weaving reed by means of a guide member located outside of the movement path to a holder located within the movement path for the end of the return element. Thus, the return member grasps during its revolving movement a portion of the return element intersecting the movement path and, while forming a loop, moves this portion of the return element to a rearward movement range of the movement path where the release device is arranged. This embodiment has the advantage that the return member must only travel a portion of the length of the path which must be traveled by the shuttle. Accordingly, the travel distance and/or travel speed of the return member are especially small.

It may be advantageous to mount the return element on the holder through a spring, so that a smoother acceleration and deceleration of the shuttle and the return element are possible. The movement characteristics of the shuttle and of the return element can be further influenced if the holder for the end of the return element is constructed so as to be drivable and movable.

The release device may be a stop cam for the return element, wherein the stop cam strips the return element from the return member. Also, the release device may be a device which retracts or disengages the return member.

The shooting device may be mounted stationary on a frame of the mechanical loom. However, this results in certain limitations with respect to the shooting phase and the return phase of the shuttle. Since, due to the low weight of the shuttle, the shooting device can be of relatively low weight and simple construction, the shooting device may be mounted laterally on the weaving reed. By mounting the shooting device on the reed in this manner, the shooting of the shuttle can be carried out even when the weaving reed is moving and, thus, the shooting can be integrated in an optimum manner in the shooting cycle.

In accordance with another advantageous feature of the present invention, the shooting device is pneumatically operated. Such a shooting device is particularly suitable for mounting on the weaving reed. A pneumatically operated shooting device may include a sleeve which receives the shuttle in the initial position. On the side facing away from the weaving reed, the sleeve may have a bottom with an opening for the return element. A compressed air line connected through a valve to a compressed air source ends near the bottom of the sleeve.

However, the shooting device may also be constructed so as to be mechanically operating. Such a mechanically operating shooting device includes a holder which receives the shuttle in the initial position. On the side facing away from the weaving reed, the holder includes a hammer which can be pretensioned by means of a spring against the shuttle. The hammer can be pretensioned by means of a revolving control cam and can be suddenly released against the shuttle. The hammer and the control cam are connected to a frame of the mechanical loom and the holder is connected to the weaving reed.

The hammer may cooperate with a pulse member arranged on the side of the holder facing away from the weaving reed. The pulse member extends at least partially over the movement range of the weaving reed and is connected to the weaving reed. As a result, the shooting device can be effective over a greater movement range of the weaving reed.

In accordance with a particularly advantageous embodiment of the present invention, the shooting device may be a mechanically/pneumatically operating device. In this case, the shooting device includes a pneumatically operated pulse member which acts on the shuttle.

In the simplest situation, the mechanical loom has only one shuttle which is shot from one side of the shed through the shed. However, it may be advantageous to provide a shooting device and a return device each on both sides of the shed for each shuttle. The shuttles may be shot alternatingly through the entire shed, so that a further increase in the output of the mechanical loom results.

However, it is also possible that the shuttles are movable only over a portion of the shed, wherein a transfer device for a thread is arranged along the shed at the end points of the movement of the shuttles. In this case, the shuttles can also be movable relative to each other either alternatingly or simultaneously. It is possible to provide along the shed at the end portions of the movement of the shuttles a joint transfer device for both shuttles or a separate transfer device for each shuttle for a weft thread introduced in the manner of a warp thread.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

DETAILED DESCRIPTION OF THE INVENTION

Figure 1:
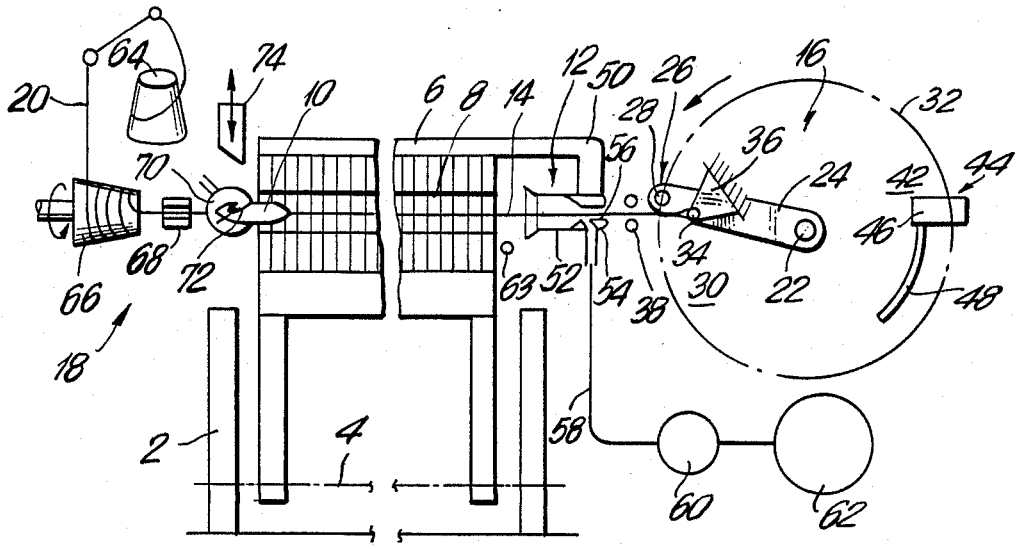
FIG. 1 is a schematic elevational view of a first embodiment of the mechanical loom according to the present invention, with the shuttle being in the receiving position, the view being taken toward the front of the weaving reed.

In the drawing and in the following description, only those components of known mechanical looms are described which are relevant wit respect to the present invention.

Figure 2:
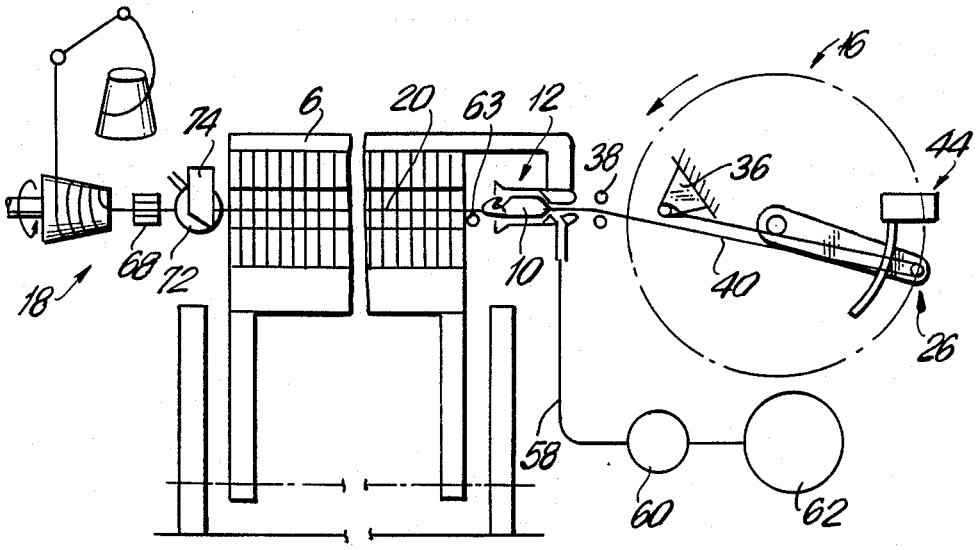
FIG. 2 shows the mechanical loom of FIG. 1, with the shuttle being in the initial position.
Figure 3:
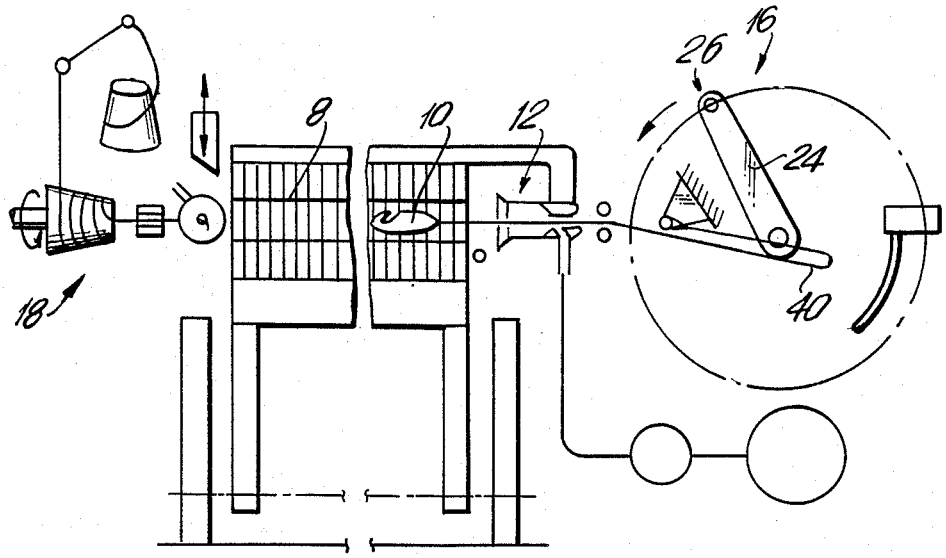
FIG. 3 shows the mechanical loom of FIG. 1, after the shuttle has been shot.
Figure 4:
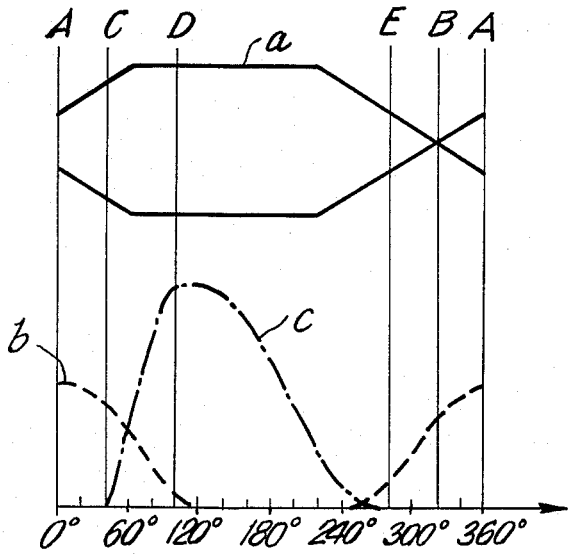
FIG. 4 is a diagram illustrating the movements of weaving reed and shuttle of the mechanical loom of FIGS. 1 to 3.

FIGS. 1 to 3 illustrate a first embodiment of the mechanical loom according to the present invention and FIG. 4 is the corresponding diagram showing the movements of the shuttle and of the weaving reed.

The mechanical loom has a frame 2 on which a weaving reed 6 is mounted rotatable about an axis 4. Weaving reed 6 includes a guide device 8 for guiding a shuttle 10 which can be shot through the shed of the mechanical loom by means of a shooting device 12. The shuttle 10 is connected through a flexible return element 14 to a return device 16 which returns the shuttle 10 from the receiving position at a transfer device 18 for a weft thread 20, as shown in FIG. 1, into the initial position at the shooting device 12, as illustrated in FIG. 2. The return element 14 may be a rope or a belt of steel, reinforced plastic material, glass fibers or the like.

The return device 16 includes a crank arm 24 mounted on a shaft 22. A return member 26 in the form of a pin 28 is arranged on the crank arm 24. The return member 26 interacts with return element 14 in a forward movement range 30 of the movement path 32 facing weaving reed 6. The return element 14 intersects the movement path 32 of return member 26. For this purpose, the rearward end 34 of return element 14 is fastened within movement path 32 to a stationary holder 36 and is guided by a guide 38 outside of movement path 32. During the further movement of the return member 26 along the movement path 32, the return member 26 takes along the flexible return element 14 so as to form a loop 40. At a rearward movement range 42, loop 40 of return element 14 is stripped from the return member 26 by means of a release device 44 arranged stationary in the rearward movement range 42, as illustrated in FIGS. 2 and 10.

Figure 10:
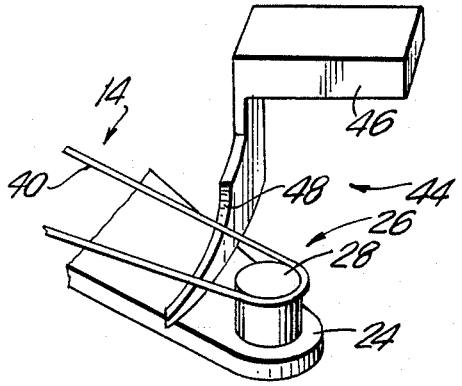
FIG. 10 is a perspective view of a first release device for the return element.

As particularly illustrated in FIG. 10, release device 44 includes a stop cam 48 fastened to an arm 46. Stop cam 48 engages between crank arm 24 and loop 40 of return element 14 and strips the loop 40 of the return element 14 from the return member 26 during the further movement of the crank arm 24.

During the return movement of return member 26, shuttle 10 is returned from the receiving position at the transfer device 18 shown in FIG. 1 to the initial position at the shooting device 12 shown in FIG. 2. Due to the loop formation, the travel path of the return member 26 is practically only half the return path of the shuttle 10. Since the return member 26 perpendicularly meets the return element 14 in the forward movement range 30 and the return element 14 is stripped at the rearward movement range 42, an advantageous acceleration and speed pattern for the return element is developed, so that the return element is smoothly accelerated at the beginning of the return movement and is smoothly decelerated at the end of the return movement. The result is a particularly careful movement characteristic of the shuttle and the return device. A further modification of this movement characteristic can be effected by a biased arrangement of the return element on the holder and/or by a driven movement of a movably constructed holder.

Shooting device 12 is fastened to weaving reed 16 by means of an arm 50, so that shooting device 12 follows the movement of the weaving reed 6. The shooting device is pneumatic and has a sleeve 52 which serves as a holder. Shuttle 10 is held in the initial position in sleeve 52, as shown in FIG. 2. On the side facing away from the weaving reed, sleeve 2 is closed by means of a bottom 54 which has an opening 56 for the flexible return element 14. Advantageously, opening 56 is sealable. A compressed air line 58 ends near bottom 54. Compressed air line 58 is connected to a compressed air source 62 through a valve 60 to form a periodically operated pulse member. The shooting device further includes a movable thread stripper 63 for separating from shuttle 10 the weft thread pulled into the shed by the shuttle.

Transfer device 18 is arranged on the side of the weaving reed 6 opposite the shooting device 12. Transfer device 18 pulls a weft thread 20 from a thread bobbin 64 by means of a premeasuring device 66. From the premeasuring device 66, the weft thread extends through a thread gripper 68 capable of being opened to a thread nozzle 70 which feeds the weft thread 20 to the shuttle, so that the shuttle can grip the weft thread by means of a thread gripper 72, as illustrated in FIG. 1. A cutting knife 74 forming part of thread nozzle 70 serves to cut the weft thread after it has been pulled into the shed.

The operation of the mechanical loom shall now be explained in detail with the aid of the diagram of the FIG. 4. The diagram of FIG. 4 shows particularly preferred sequences of movement. Other sequences are also possible. In the diagram of FIG. 4, a curve a illustrates the movement pattern of the warp thread of the warp shed, curve b shows the movement pattern of weaving reed 6 and curve c shows the movement pattern of the shuttle 10. The work cycle of a loom is usually counted from the stop of the weaving reed at the stop edge of the material and is indicated in angular degrees of the rotation of a main drive shaft, not shown. The shed is again already opened after the stop of the weaving reed 6 at the stop edge (phase A) which immediately follows after the intersection of the warp threads of the shed (phase B), wherein the intersecting warp threads are approximately in the same plane. In phase c, in which the weaving reed 6 is still in the return movement and the shed has not yet been completely opened, the shuttle 10 is shot at 40° into the shed from the initial position shown in FIG. 2.

For shooting the shuttle, valve 60 is opened for a short period of time and a thrust of compressed air reaches between bottom 54 and shuttle 10 into sleeve 52 and drives the shuttle from the sleeve 52 through the shed. In position D, i.e., at an angle of rotation of approximately 100°, the shooting procedure is concluded and the shuttle 10 is in the receiving position at transfer device 18 shown in FIG. 1. This end position is determined by the length of the flexible return element. At the transfer device 18, the thread gripper 68 opens and the thread nozzle 70 places the beginning of the weft thread 20 into the thread gripper 72 of shuttle 10. Shooting of the shuttle 10 into the shed and placing the weft thread in the shuttle 10 are carried out practically during the return movement of the weaving reed 6. The return of the shuttle 10 by means of the return device 16 is carried out over a longer period of time and is concluded in position E, i.e., an angle of rotation of 280° (FIG. 2). During this phase, the separation of the weft thread 20 by means of the cutting knife 74 and the stripping of the weft thread at the shuttle by means of the thread stripper 63 are carried out. The last phase of the return movement takes place already during the first phase of the forward movement of the weaving reed 6. In position B, i.e., an angle of rotation of 320°, the shed is again closed. A new shooting cycle begins at 0°.

FIGS. 5 to 9 of the drawing show different types of shuttles and guidances of the shuttle through the shed.

Figure 5:
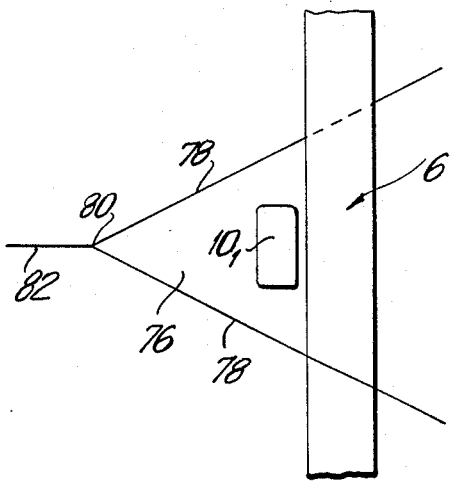
FIG. 5 is an illustration of an unguided arrangement of the shuttle through the shed, the view being taken toward the side of the weaving reed.

The simplest case is illustrated in FIG. 5. Shuttle $10_1$ has a rectangular cross-section and is moved unguided through the shed 76 and is supported, if at all, on weaving reed 6. FIG. 5 further shows the formation of the shed 76 by warp threads 78 which come together at the stop edge 80 and continue into the fabric 82.

Figure 6:
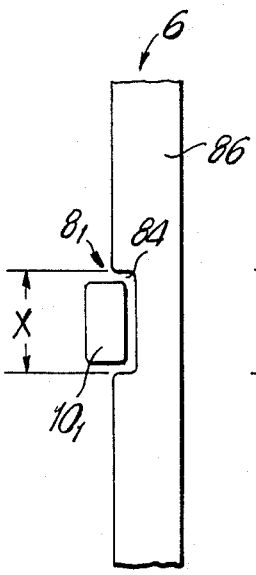
FIG. 6 shows a first guide device for the shuttle on the weaving reed, the view being taken toward the side of the weaving reed.

FIG. 6 shows a simple guide device $8_1$ for shuttle $10_1$, wherein this guide device is formed by rectangular recesses 84 in reed rods 86 of weaving reed 6. In this type of guidance, the shuttle 10 is guided only toward three sides. The shuttle 10 is not guided toward the front in the direction toward the stop edge.

Figure 7:
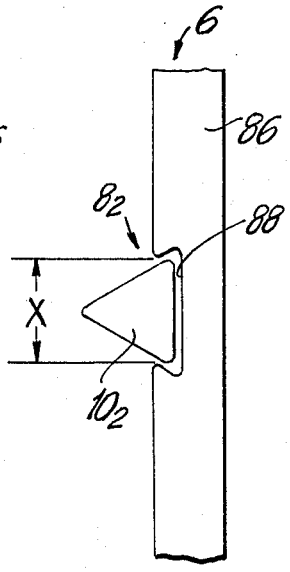
FIG. 7 shows a second guide device for the shuttle on the weaving reed, the view being taken toward the side of the weaving reed.

FIG. 7 shows a complete guidance of the shuttle $10_2$. In this case, the guide device 82 has a triangular cross-section. The individual reed rods 86 of the weaving reed 6 are provided with dovetail-shaped recesses 88.

Figure 8:
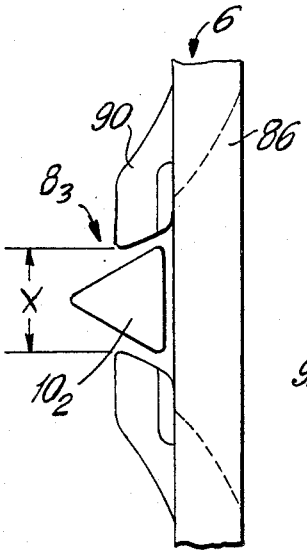
FIG. 8 shows a third guide device for the shuttle on the weaving reed, the view being taken toward the side of the weaving reed.

In the embodiment of FIG. 8, the guide device 83 of the shuttle 102 is formed by additional guide lamellae 90 which project from the weaving reed 6 in the direction toward the stop edge 80.

Figure 9:
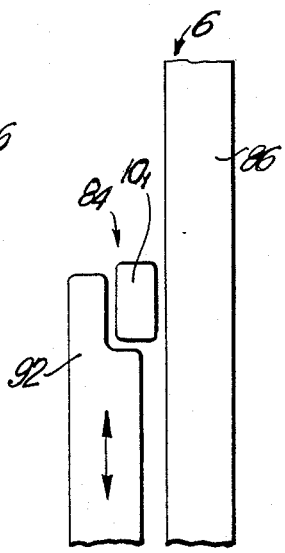
FIG. 9 shows a fourth guide device for the shuttle on the weaving reed, the view being taken toward the side of the weaving rod.

Finally, FIG. 9 shows another guide device $8_4$ with extendable and retractable guide lamellae 92 which are retracted during the stopping of the reed. The portions denoted with X indicate the free space for the stop of the weaving reed 6 at the stop edge 80.

Figure 11:
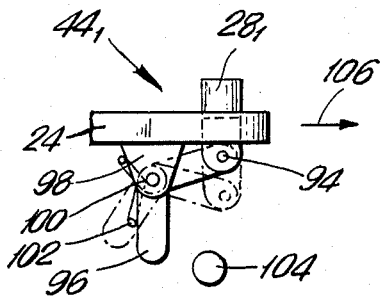
FIG. 11 is a view of a second release device for the return element, the view being taken transversely of the direction of movement of the return member.

FIG. 11 shows another variation of a release device $44_1$, for example, for return device 16 of FIG. 1. In this case, pin $28_1$ is retractably mounted on crank arm 24 and is connected on the rear side of the crank arm through a joint 94 to a two-armed lever 96 which is swivelably mounted on an axis 100 in a bearing block 98. A return spring 102 holds lever 96 and, thus, pin $28_1$ in the forwardly moved position. A stationary stop 104 is provided for actuating the stripping device $44_1$. Upon further movement of the crank arm 24 in the direction of movement 106, the stop 104 pivots lever 96 into the position indicated in broken lines and, thus, retracts the pin $28_1$ flush with the crank arm 24, and, thus, releases the return element 14.

Figure 12:
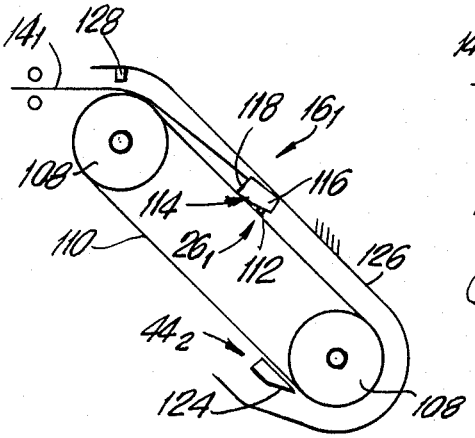
FIG. 12 is a side view of a second return device.
Figure 13:
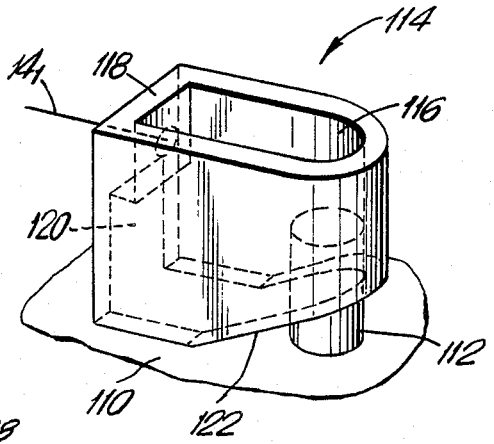
FIG. 13 shows, on a larger scale and in a perspective view, the drive member of the return element of FIG. 12.

FIGS. 12 and 13 show another embodiment of a return device $16_1$. The return device $16_1$ includes a belt 110 revolving about two rollers 108, one of which is driven. A return member $26_1$ in the form of a pin 112 is arranged on belt 110. Return element $14_1$ has at its rearward end a drive member 114 which rests on belt 110 in the range of movement of the return member $26_1$, Drive member 114 includes a forward stirrup 116 and a rearward plate 118, the return element $14_1$ being fastened to plate 118. Rearward plate 118 has an opening 120 through which pin 112 can penetrate into drive member 114 and can rest against stirrup 116. At the bottom side of drive member 114, stirrup 116 is provided with a beveled stop surface 122 which makes contact with an appropriate stop cam 124 at a stationary stripping device $44_2$, so that drive member 114 can be stripped from the pin 112 of return member $26_1$. A guide 126, for example, having U-shaped cross-section, for the driving member 114 is arranged parallel to the belt 110 in the range of movement of the drive member 114. When the drive member 114 is separated from the return member $26_1$ and the shuttle is shot into the shed, the drive member 114 is returned along guide 126 into the initial position which is determined by stops 128 at guide 126. Stops 128 act on the rearward plate 118 of drive member 114 and prevent a further movement of the drive member 14 and, thus, of return element $14_1$.

Figure 14:
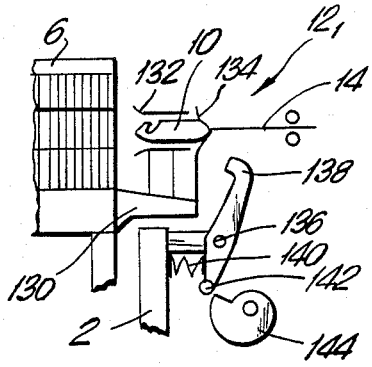
FIG. 14 shows another mechanical shooting device, the view being taken toward the front of the weaving reed.

FIG. 14 shows another embodiment of a mechanically constructed shooting device $12_1$. The shooting device $12_1$ has a holder 132 which is fastened to the weaving reed 6 over an arm 130. Holder 132 receives the shuttle 10 in the initial position. On the side of the holder facing away from the weaving reed 6, a pulse member 134 is mounted on arm 130 spaced apart from holder 132. Pulse member 134 simultaneously serves as the stop for the shuttle 10 in the initial position.

Pulse member 134 extends over the movement range of weaving reed 6. A two-armed hammer 138 which is pivotally mounted on a stationary axis 136, interacts with the pulse member 134 which is unilaterally fastened and may be spring-biased. Hammer 138 is pretensioned by means of a spring 140 against pulse member 134 and, thus, against shuttle 10. A drive member 142 at hammer 138 interacts with a revolving control cam 144 which periodically pretensions spring 140 and then suddenly releases spring 140, so that hammer 138 shoots by means of pulse member 134 the shuttle held in holder 132. Pulse member 134 which extends over the movement range of the weaving reed ensures that the shuttle can also be shot even if the hammer 138 is not located exactly opposite shuttle 10 but offset relative to shuttle 10.

Figure 15:
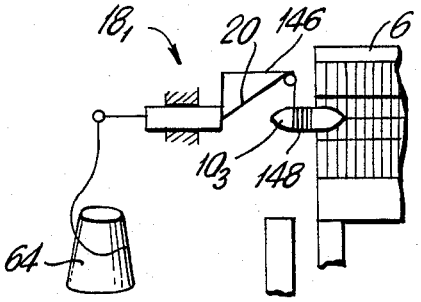
FIG. 15 shows another transfer device for winding a thread supply onto the shuttle, the view being taken toward the front of the weaving reed.

FIG. 15 shows another transfer device $18_1$ which includes a guide arm 146 which rotates about a shuttle $10_3$. Guide arm 146 pulls the weft thread 20 from a thread bobbin 64 and winds a thread supply 148 onto shuttle $10_3$. A separating device, not shown, serves to cut the weft thread 20 as soon as a sufficient supply of thread has been wound onto the shuttle and the shuttle $10_3$ has been returned into its initial position. The thread supply corresponds to the length of the weft thread to be introduced.

A large number of other embodiments are possible. Particularly, electromagnetically operating units are possible, for example, for the shooting device and the stripping device. In a particularly advantageous arrangement, two or more return devices of the type illustrated in FIG. 1 may be arranged one behind the other in series. In this case, the return element is to be arranged on a stationary holder on the last return device within the movement path. The return devices arranged before the last return device must each have a deflection roller within the movement path, wherein each deflection roller conducts the return element to the next following return device.

The shooting device may also be constructed pneumatically/mechanically. In this case, a pneumatically operated hammer may act directly or indirectly on the shuttle through a pulse member.

In the illustrated embodiments, only one shuttle is moved through the shed from one side of the fabric web over the entire width of the web. However, it is also possible to shoot shuttles by means of appropriate shooting devices from both sides of the shed. These shuttles may be shot alternatingly and may be guided through the entire shed. However, it is also possible to shoot these shuttles either simultaneously against each other or alternatingly over only a portion of the shed, preferably to the middle of the shed. In the middle of the shed, a transfer device for a weft thread supplied in the manner of a warp thread may be arranged for always one or for both shuttles.

While specific embodiments of the invention have been shown and described in detail to illustrate the application of the inventive principles, it will be understood that the invention may be embodied otherwise without departing from such principles.

I claim:

1. A mechanical loom, comprising a shuttle for a weft thread, a shooting device for shooting the shuttle into the shed, a return device for the shuttle, a transfer device for transferring a weft thread to the shuttle, the shuttle being capable of introducing the weft thread into the shed during a return movement of the shuttle, a flexible return element coupling the shuttle to a return member of the return device, the return device including a release device for releasing from the return member the return element when the shuttle has reached an initial position.

2. The mechanical loom according to claim 1, wherein the return element is a rope.

3. The mechanical loom according to claim 1, wherein the return element is a belt.

4. The mechanical loom according to claim 1, wherein the shuttle is capable of receiving a thread supply for a weft thread, the weft thread being applied by means of the transfer device.

5. The mechanical loom according to claim 1, wherein the shuttle is a gripper shuttle for gripping a weft thread fed by the transfer device.

6. The mechanical loom according to claim 1, wherein the shuttle is configured to be shot into the shed in an unguided manner.

7. The mechanical loom according to claim 1, comprising a weaving reed, the weaving reed provided with a guide device for the shuttle.

8. The mechanical loom according to claim 7, wherein the guide device is formed by guide lamellae.

9. The mechanical loom according to claim 7, wherein the weaving reed includes reed rods, the reed rods defining a guide recess for the shuttle in the region of a weft thread stop.

10. The mechanical loom according to claim 7, wherein the guide device includes projections, the projections laterally extending over the shuttle.

11. The mechanical loom according to claim 7, wherein the guide device is capable of holding the shuttle in a receiving position at the transfer device.

12. The mechanical loom according to claim 1, comprising a weaving reed, the weaving reed having a lateral arm of a holder for holding the shuttle in an initial position and at the shooting device.

13. The mechanical loom according to claim 1, wherein the return device includes a revolvable return member, an end of the return element being releasably fastened to the return member.

14. The mechanical loom according to claim 13, wherein the return device includes a revolving member, the outwardly projecting return member being fastened to the revolving member, the end of the return element having a drive member, wherein the drive member, in the receiving position of the shuttle, is placed on a forwardly moving portion of the revolving member in the travel path of the return member, so that the return member is capable of grasping the drive member of the return element and the drive member of the return element is taken to the release device.

15. The mechanical loom according to claim 1, comprising a weaving reed, the return device having a return member, the return member revolving along a closed movement path, the return element being guided in a forward movement portion of the movement path facing the weaving reed by means of a guide member located outside of the movement path to a holder located within the movement path for an end of the return element, so that the return element, during its revolving movement, grasps a portion of the return element intersecting the movement path and, while forming a loop, moves this portion of the return element to a rearward movement range of the movement path where the release device is arranged.

16. The mechanical loom according to claim 1, wherein the movement path of the return device is circular.

17. The mechanical loom according to claim 15, wherein the holder for the end of the return element is figured to be movably driven.

18. The mechanical loom according to claim 1, wherein he release device is a stop cam for the return element, the stop cam capable of stripping the return element from the return member.

19. The mechanical loom according to claim 1, wherein the release device includes means for retracting or disengaging the return member.

20. The mechanical loom according to claim 1, wherein the shooting device is mounted stationary on a frame of the loom.

21. The mechanical loom according to claim 1, wherein the shooting device is mounted laterally on a weaving reed.

22. The mechanical loom according to claim 1, wherein the shooting device is a pneumatic device.

23. The mechanical loom according to claim 22, wherein the pneumatic shooting device includes a sleeve, the sleeve receiving the shuttle in the initial position, the sleeve having on the side facing away from the weaving reed a bottom which defines an opening for the return element, a compressed air line connected through a valve to a compressed air source, the compressed air line ending near the bottom of the sleeve.

24. The mechanical loom according to claim 1, wherein the shooting device is a mechanical device.

25. The mechanical loom according to claim 24, wherein the shooting device includes a holder, the holder receiving the shuttle in the initial position, the loom including a weaving reed, wherein the holder, on the side facing away from the weaving reed, includes a hammer capable of being pretensioned by means of a spring against the shuttle, the hammer being pretensionable by means of a revolving control cam and being suddenly releasable against the shuttle.

26. The mechanical loom according to claim 24, wherein the hammer and the control cam are mounted on a frame of the loom and the holder is mounted on the weaving reed.

27. The mechanical loom according to claim 26, comprising a pulse member, the hammer interacting with the pulse member, wherein the pulse member extends at least partially over the movement range of the weaving reed and is connected to the weaving reed, the pulse member being mounted on the side of the holder facing away from the weaving reed and interacting with the holder.

28. The mechanical loom according to claim 22, wherein the shooting device includes a pneumatically operated pulse member which acts on the shuttle.

29. The mechanical loom according to claim 24, wherein the shooting device includes a pneumatically operated pulse member which acts on the shuttle.

30. The mechanical loom according to claim 1, wherein the return element is a thread.

31. The mechanical loom according to claim 1, wherein the return element is a wire.

* * * * *